US006800003B2

(12) United States Patent
Hill et al.

(10) Patent No.: US 6,800,003 B2
(45) Date of Patent: Oct. 5, 2004

(54) APPARATUS AND METHOD FOR STEERING A JET PROPELLED WATER CRAFT

(75) Inventors: Leonard E. Hill, Alexander, AR (US); Jason T. Hill, Alexander, AR (US)

(73) Assignee: North American Marine Jet, Inc., Benton, AR (US)

( * ) Notice: Subject to any disclaimer, the term of this patent is extended or adjusted under 35 U.S.C. 154(b) by 0 days.

(21) Appl. No.: 10/463,214

(22) Filed: Jun. 16, 2003

(65) Prior Publication Data

US 2004/0038601 A1 Feb. 26, 2004

Related U.S. Application Data

(60) Provisional application No. 60/389,083, filed on Jun. 14, 2002.

(51) Int. Cl.[7] ..... B63H 11/11
(52) U.S. Cl. ..... 440/41; 440/42
(58) Field of Search ..... 440/38, 40, 41, 440/42, 43

(56) References Cited

U.S. PATENT DOCUMENTS

| | | | | |
|---|---|---|---|---|
| 3,134,357 A | | 5/1964 | Cochran | |
| 3,241,770 A | | 3/1966 | Reynolds et al. | |
| 3,258,916 A | | 7/1966 | Lehmann | |
| 3,942,464 A | | 3/1976 | Schoell | |
| 5,344,344 A | | 9/1994 | Forsstrom | |
| 5,704,817 A | | 1/1998 | Vaughn | |
| 5,934,954 A | * | 8/1999 | Schott et al. | 440/41 |
| 6,045,418 A | * | 4/2000 | Roos | 440/38 |
| 6,142,841 A | | 11/2000 | Alexander, Jr. et al. | |
| 6,227,919 B1 | | 5/2001 | Blanchard | |
| 6,299,494 B1 | | 10/2001 | Bowers et al. | |
| 6,386,930 B2 | | 5/2002 | Moffet | |
| 6,553,835 B1 | * | 4/2003 | Hobbs et al. | 73/514.16 |

* cited by examiner

*Primary Examiner*—Stephen Avila
(74) *Attorney, Agent, or Firm*—Mark Rogers; Gary N. Speed

(57) ABSTRACT

An apparatus and method are disclosed which allow a stream to be divided so that a portion continues to provide forward or reverse thrust while a portion is diverted to provide lateral thrust. The apparatus has a frame and a side diverter connected thereto. The side diverter is movable into and out of the path of a water stream from a jet propulsion unit to divert at least a portion of the water stream to provide lateral thrust. The apparatus preferably has two side diverters that may or may not be independently operable. The apparatus also preferably has one or more reverse diverters connected to the frame. The frame is preferably pivoted about two axes to move the side diverters into and out of the path of the water stream, and the reverse diverter preferably pivots about an axis that is perpendicular to these axes.

20 Claims, 8 Drawing Sheets

APPARATUS AND METHOD FOR STEERING A JET PROPELLED WATER CRAFT

This application claims the benefit of U.S. Provisional Application Ser. No. 60/389,083, filed on Jun. 14, 2002, the disclosure of which is incorporated herein by reference.

BACKGROUND OF THE INVENTION

The present invention relates to water craft steering and more particularly to an apparatus and method for steering jet propelled water craft.

Jet propelled water craft are well known. In a typical jet propelled water craft, a jet propulsion unit is installed or incorporated into a stem portion of the hull, and a water tunnel in the bottom of the hull provides water to the jet propulsion unit. A drive shaft is mated with an impeller which is rotatably secured to a stator hub within a stator housing. Stator vanes secure the stator hub within the stator housing and redirect the swirling flow from the impellers into non-swirling flow. A water stream is driven from the exit housing to provide forward thrust to the water craft.

In a typical jet propelled water craft, steering is accomplished using a cone or nozzle that is pivotally secured to the exit nozzle. If forward thrust is being providing and the operator wishes to turn to the right or starboard, the steering nozzle is pivoted to the right or starboard. This provides a thrust component at the stern of the boat in the left or port direction which in turn drives the bow of the boat to the right or starboard side. Similarly, to turn to the left or port side, the nozzle is rotated to the left or port side. This method of steering works reasonably well but suffers from some disadvantages. For example, the range of motion of a typical steering nozzle or cone is only approximately 30° in either direction. This places undesirable limits on the left and right thrust component of the water stream, thereby placing undesirable limits on the magnitude of the left and right thrust available. Further, because the nozzle redirects the entire water stream to accomplish a turn, this method of steering makes inefficient use of the water stream provided by the jet propulsion unit and undesirably reduces the forward thrust of the stream during turning.

In a typical jet propelled water craft, reverse thrust is provided using a reverse nozzle that is pivotally attached to the steering nozzle and that pivots up or down to block the exit of the steering nozzle and redirect the water stream downward and forward. This provides reverse thrust. If the steering nozzle is turned while the reverse nozzle redirects the flow of the water stream, a portion of the redirected water stream provides lateral thrust to aid in steering while in reverse. Again, because the steering and reverse nozzles redirect the entire water stream to accomplish a turn in reverse, this method makes inefficient use of the water stream provided by the jet propulsion unit. Also, the lateral thrust available while in reverse is typically very limited. Redirecting the entire water stream to accomplish a turn while in reverse also reduces the rearward thrust of the stream during turning.

SUMMARY OF THE INVENTION

It is therefore an object of the present invention to provide an apparatus and method for steering a jet propelled water craft that allows for improved handling in forward and reverse.

It is a further object of the present invention to provide an apparatus and method of the above type that diverts a portion of a water stream to provide lateral thrust.

It is a still further object of the present invention to provide an apparatus and method of the above type that provides for increased forward or rearward thrust during turning.

It is a still further object of the present invention to provide an apparatus and method of the above type that provides for increased lateral thrust during turning.

It is a still further object of the present invention to provide an apparatus and method of the above type that makes efficient use of a water stream provided by a jet propulsion unit.

It is a still further object of the present invention to provide an apparatus and method of the above type that avoids unnecessary diversion of a water stream provided by a jet propulsion unit.

It is a still further object of the present invention to provide an apparatus and method of the above type that avoids the power demands required to divert an entire water stream provided by a jet propulsion unit.

It is a still further object of the present invention to provide an apparatus and method of the above type that provides added flexibility in providing thrust at greater angles from a centerline of a water craft.

It is a still further object of the present invention to provide an apparatus and method of the above type that provides lateral thrust at angles greater than 30° from a centerline of a water craft.

It is a still further object of the present invention to provide an apparatus and method of the above type that provides lateral thrust at an angle of approximately 70° from a centerline of a water craft.

It is a still further object of the present invention to provide an apparatus and method of the above type that provides for neutral operation in which a water stream from a jet propulsion unit is diverted to provided neither forward nor reverse thrust.

It is a still further object of the present invention to provide an apparatus and method of the above type that provides for simple linear movement of side and reverse diverters.

It is a still further object of the present invention to provide an apparatus and method of the above type that may be used in connection with water craft having multiple jet propulsion units.

It is a still further object of the present invention to provide an apparatus and method of the above type in which a frame of simple construction houses both side and reverse diverters.

It is a still further object of the present invention to provide an apparatus and method of the above type that provides for improved handling while minimizing any unnecessary disruption of a water stream from a jet propulsion unit.

It is a still further object of the present invention to provide an apparatus and method of the above type that provides for improved control of reverse thrust.

It is a still further object of the present invention to provide an apparatus and method of the above type that uses two reverse diverters for improved control of reverse thrust.

It is a still further object of the present invention to provide an apparatus and method of the above type that uses non-linear motion to move diverters into and out of the path of a water stream.

It is a still further object of the present invention to provide an apparatus and method of the above type that uses a frame that is pivotal about two axes to move diverters into and out of the path of a water stream.

It is a still further object of the present invention to provide an apparatus and method of the above type that moves a frame from a position parallel to a jet propulsion discharge outlet during un-diverted flow to a position that is not parallel to a jet propulsion discharge outlet during diverted flow.

Toward the fulfillment of these and other objects and advantages, the apparatus and method of the present invention allow a water stream to be divided so that a portion continues to provide forward or reverse thrust that is substantially parallel to a centerline of a water craft while a portion is diverted to provide lateral thrust that is not substantially parallel to a centerline of a water craft. The apparatus of the present invention has a frame and a side diverter operably connected to the frame, the side diverter being movable into and out of the path of a water stream from a jet propulsion unit to divert at least a portion of the water stream to provide lateral thrust. The apparatus preferably has two side diverters that may or may not be independently operable. The apparatus also preferably has one or more reverse diverters operably connected to the frame. The frame is preferably pivoted about two axes to move the side diverters into and out of the path of the water stream, and the reverse diverter preferably pivots about an axis that is perpendicular to these axes.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings, wherein.

DETAILED DESCRIPTION OF THE PREFERRED EMBODIMENT

Figure 1:
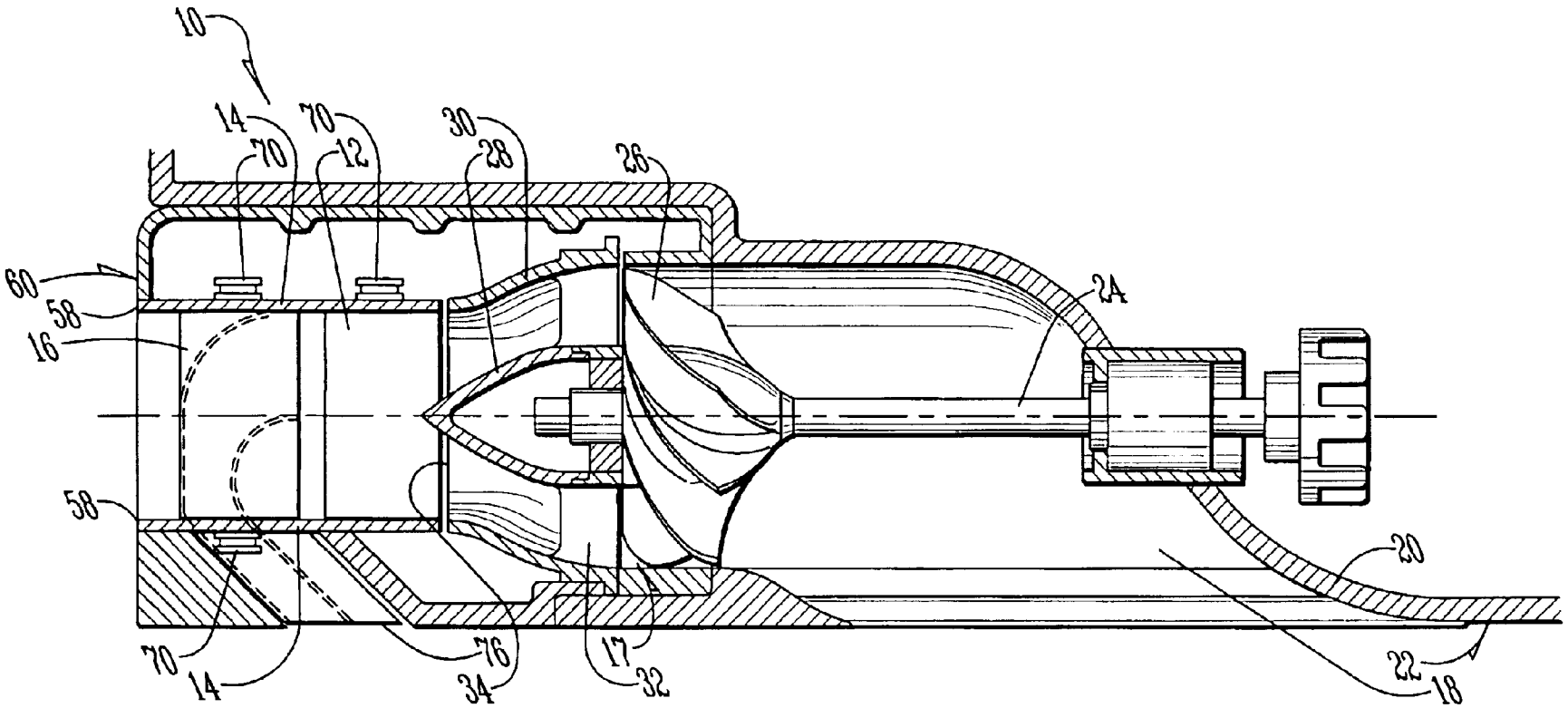
FIG. 1 is a side, schematic view of a device for practicing the present invention.

Referring to FIG. 1, reference numeral 10 refers in general to a steering device of the present invention. The device 10 comprises one or more side diverters 12 that may be operably connected to a frame 14. One or more reverse diverters 16 may also be operably connected to the frame 14. The frame 14 is affixed to a water craft and aligned with a jet propulsion unit so that a water stream generated by the jet propulsion unit 17 passes through the frame 14.

A water tunnel 18 will typically be provided in a hull 20 of the water craft 22 for supplying water to the jet propulsion unit 17. A drive shaft 24 is also coupled with the jet propulsion unit 17. In a typical jet propulsion unit 17, impellers 26 are operably connected to and driven by the drive shaft 24. A stator hub 28 supports the impellers 26 for rotation within the stator housing 30. Stator vanes 32 support the stator hub 28 within the stator housing 30 and act to redirect the swirling flow from the impellers 26 into non-swirling flow. The water stream exits an exit nozzle or discharge outlet 34 affixed to or forming part of the stator housing 30.

Figure 2:
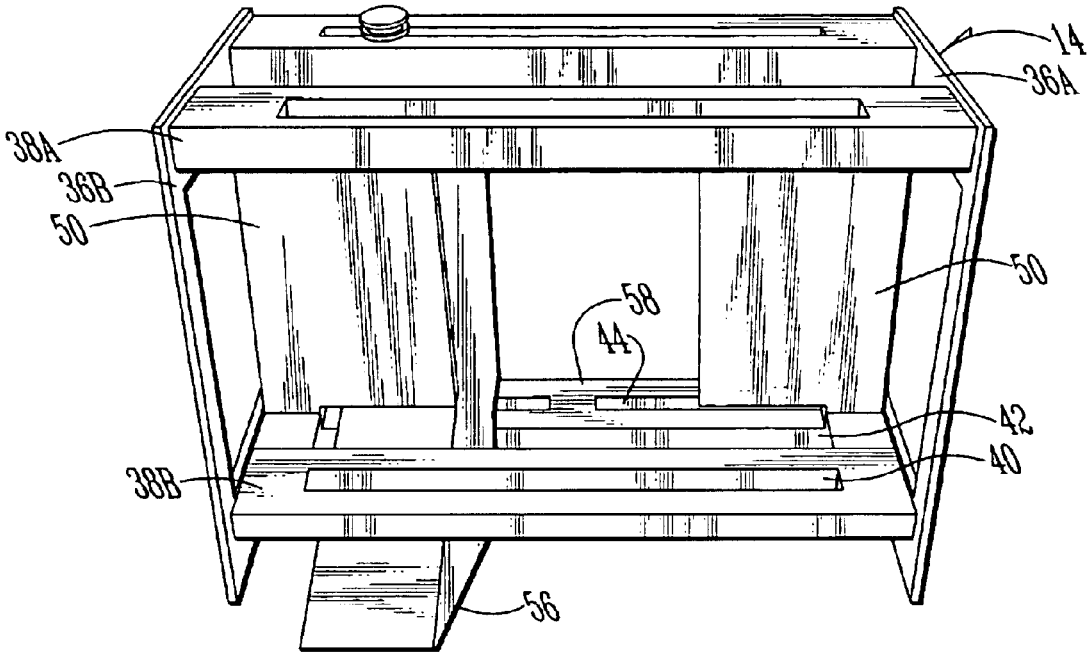
FIG. 2 is a front, elevation view of a device for practicing the present invention, with side diverters and one reverse diverter omitted.
Figure 3:
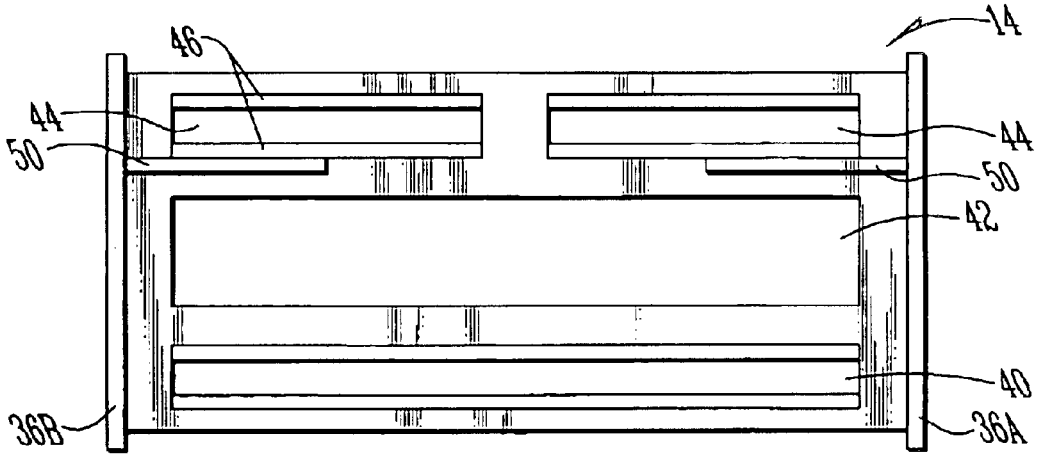
FIG. 3 is an overhead, cutaway view of a frame for a device for practicing the present invention.

As best seen in FIG. 2, the frame 14 has port and starboard side members 36A and 36B and upper and lower transverse members 38A and 38B. Referring to FIG. 3, the lower transverse member 38B has one or more front slots 40, medial slots 42, and rear slots 44, for reasons to be described. Slide members 46, preferably formed from UHMW plastic, are provided for the front and rear slots 40 and 44 and may be provided for the medial slot 42. The upper transverse member 38A also has one or more front and rear slots 40 and 44. The slots 40, 42, and 44 preferably define substantially horizontal, substantially linear paths aligned substantially perpendicular to a centerline 48 of the water craft 22, but it is understood that the slots may take any number of different shapes, sizes, and alignments. Planar members or plates 50 also extend substantially vertically between the upper and lower transverse members 38A and 38B. A central opening or channel 52 formed by the frame 14 is disposed downstream of the exit nozzle 34 of the jet propulsion unit 17 and provides an open path for the water stream 54 exiting the jet propulsion unit, unless a side diverter 12 or reverse diverter 16 is moved into the path of the water stream 54. The back edges of the transverse members 38A and 38B mark a discharge exit 58 for the frame 14. A cover or shroud 60 (FIG. 1) may also be affixed to the frame 14.

Figure 4:
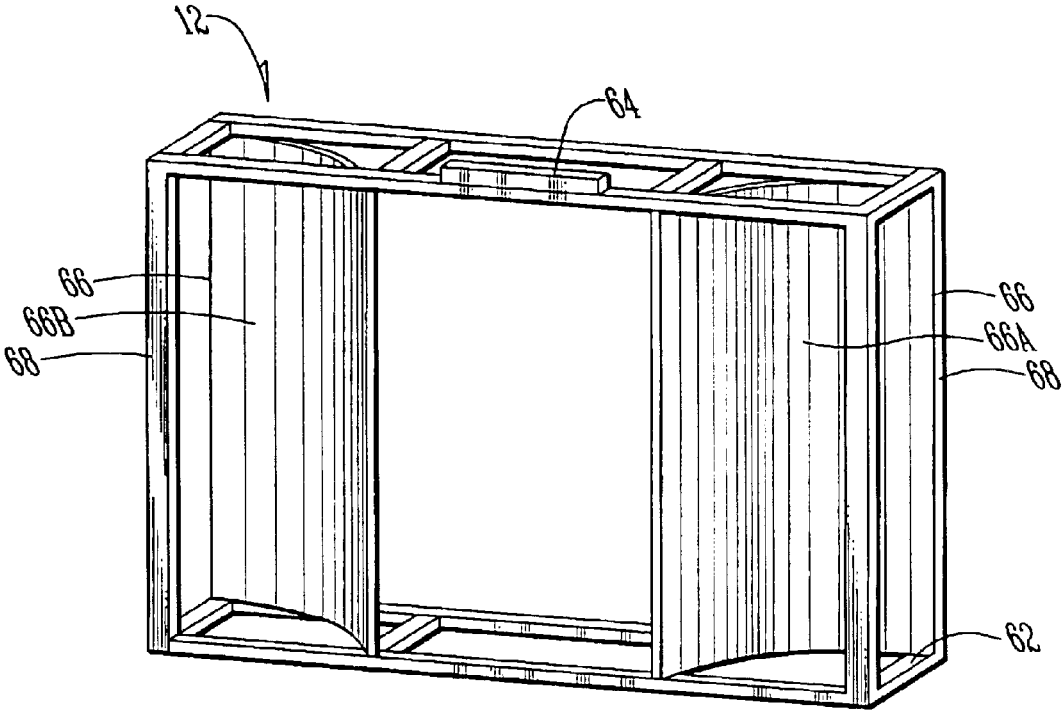
FIG. 4 is a front, elevation view of a side diverter for practicing the present invention.

Referring to FIG. 4, the side diverter 12 is symmetrical about a centerline. A generally rectangular frame 62 is provided, sized to fit within the side members 36A and 36B and transverse members 38A and 38B of the frame 14. One or more guide members 64 are secured to upper and lower portions of the diverter frame 62. Curved plates 66 are secured to opposite sides of the frame 62. Although curved plates 66 are preferred, it is understood that the surfaces may take any number of different shapes, and that blocks, wedges, or any number of different configurations may be used in place of plates 66. The sides 68 of the frame 62 are open.

FIG. 4 shows a side diverter 12 in which the port and starboard diverter plates 66A and 66B are connected as a single unit. In this embodiment, the port and starboard diverter plates 66A and 66B are not movable independent of each other. FIGS. 8–11 depict an embodiment in which the port and starboard diverters 12 are independently operable. There are tradeoffs for either embodiment. Incorporating the port and starboard diverters 12 into a single unit simplifies construction and operation and likely yields a more durable embodiment. Using independently operable port and starboard diverters 12 allows for greater flexibility in operation. For example, it would allow both diverters 12 to block the path of the water stream 54 at once so that a water craft 22 could quickly and easily be placed in "neutral" with no forward or rearward thrust. Further, each independent diverter 12 may extend along a greater portion of the width of the frame 14 without the need for it to extend to a position outside the frame 14 during operation. For example, in the combined unit, when the port diverter 12 moves to the right to divert a portion 54A of the water stream 54, the starboard diverter 12 also moves to the right. If the starboard diverter 12 occupies substantially the entire width of the frame 14 area to the starboard side of the water stream 54, this means that the starboard diverter 12 would need to travel to a position extending outside the frame 14 when the port diverter 12 is moved to the right into the water stream 54. The same would be true for the port diverter 12 as the starboard diverter 12 moved left to divert a portion 54A of the stream 54. Space considerations may make this undesirable or unworkable. Accordingly, in the embodiment using the combined unit, it may be desirable for the starboard plate 66B to occupy only approximately one half of the width of the frame 14 area to the starboard side of the water stream 54. Similarly, it may be desirable for the port plate 66A to occupy only approximately one half of the width of the frame 14 area to the port side of the water stream 54. In this way, the unit may be moved in either direction without extending a diverter plate outside the frame 14. Because the independent diverters 12 can be made larger without the disadvantages discussed above, the independent diverters 12 may divert a greater portion 54A of the water stream 54 to provide greater lateral thrust. Similarly, because the independent diverters 12 can be made larger without the disadvantages discussed above, the independent diverters 12 can provide for more gradual redirection of the water stream 54, reducing power losses that can arise from turbulence created by the redirection.

Referring to FIG. 1, one or more hydraulic cylinders 70 are used to move the port and starboard diverters into and out of the path of the water stream 54. It is of course understood that any number of different linkages may be used and any number of different powering means may be used to move the diverters 12. In the embodiment using the combined unit, the port and starboard diverters 12 are powered by a single hydraulic cylinder linked to the upper guide member 64. In the embodiment using independent port and starboard diverters 12, it is preferred to power each diverter with two hydraulic cylinders 70, one linked to the upper guide member 64 and one linked to the lower guide member 64. The torque caused by the water stream 54 striking the diverter plates 66 can be great. In the combined unit, the frame 62 and guide members 64 can provide for greater surface areas for resisting this torque, so the large combined unit is less likely to experience problems with twisting due to the torque caused by the water stream 54 striking one of the diverter plates 66. Accordingly, the extra strength and support of a lower linkage may not be needed for the larger combined unit. It is of course understood that any number of different drive combinations may be used for either embodiment, including but not limited to using upper and lower drives, upper drives only, or lower drives only on either embodiment.

Figure 5:
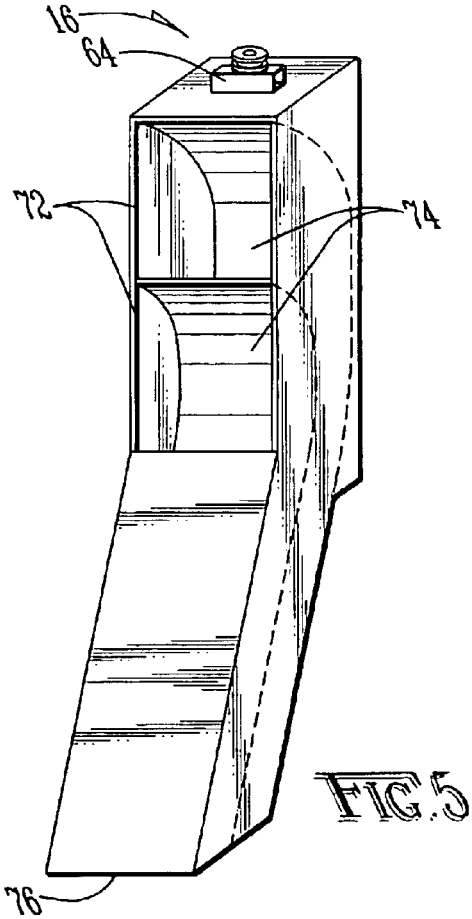
FIG. 5 is a front, elevation view of a reverse diverter for practicing the present invention.

FIG. 5 shows a reverse diverter 16 for use in connection with the present invention. Guide members 64 are affixed to upper and lower portions of the reverse diverter 16. The guide members 64 fit within slots 44 and may be used as a convenient point to which to attach a hydraulic cylinder 70 or other means for moving the reverse diverter 16. An upper portion of a front face of the diverter has one or more inlet openings 72, leading to one or more conduits 74 for redirecting portions of the water stream 54. Although one conduit 74 may be used, in this embodiment, it is preferred to use two conduits 74 for each reverse diverter 16. This adds to the structural integrity and durability of the reverse diverter 16 and reduces power losses caused by turbulence as the water stream 54 is redirected. Each conduit 74 curves downward and forward. A lower portion of the reverse diverter 16 passes through slot 42 to a discharge outlet 76 below the frame 14. As seen in FIG. 1, the discharge outlet 76 is preferably disposed substantially horizontally, aligned with a bottom surface of the cover 60. The conduits 74 are angled downward and forward at the discharge outlet 76 and are aligned substantially parallel with a centerline 48 of the water craft 22.

As best seen in FIGS. 6–11, in this embodiment, two reverse diverters 16 are preferably used, each disposed downstream of the side diverters 12 and upstream of a discharge outlet 58 of the frame 14. When not in use, one reverse diverter 16 is disposed to the port side of the water stream 54 and one is disposed to the starboard side of the water stream 54. Inboard walls of each inlet opening 72 of each reverse diverter 16 are preferably beveled so that, when the two reverse diverters 16 are brought into contact with one another during full reverse operation, the touching walls generally form a point to reduce turbulence as the water stream 54 strikes the reverse diverters 16. Each plate 50 is sized to cover the inlet openings 72 of the associated reverse diverter 16 when the reverse diverter 16 is out of the path of the water stream 54. Although one reverse diverter 16 may be used, it is preferred to use two separate reverse diverters 16, which may or may not be independently operable. Similar to the discussion above concerning the side diverter 12, using two reverse diverters 16 allows each reverse diverter 16 to fit within the frame 14. If a single reverse diverter 16 were used, the frame 14 would need to be undesirably wide on one side to accommodate a reverse diverter 16 that is wide enough to intercept the entire water stream 54.

Referring to FIG. 1, similar to the discussion above in connection with the side diverters 12, one or more hydraulic cylinders 70 are used to move the port and starboard reverse diverters 16 into and out of the path of the water stream 54. It is of course understood that any number of different linkages may be used and any number of different powering means may be used to move the reverse diverters 16. In the embodiment using a port and starboard reverse diverter 16, it is preferred to power each reverse diverter 16 with two hydraulic cylinders 70, one linked to the upper guide member 64 and one linked to the lower guide member 64. The torque caused by the water stream 54 striking the reverse diverter 16 conduits 74 can be great. If a larger, single reverse diverter 16 is used, the guide members 64 can provide for greater surface areas for resisting this torque, so the larger, single reverse diverter 16 would be less likely to experience problems with twisting due to the torque caused by the water stream 54 striking the conduits 74. Accordingly, the extra strength and support of a lower linkage may not be needed for the larger, single reverse diverter 16. It is of course understood that any number of different drive combinations may be used for either embodiment, including but not limited to using upper and lower drives, upper drives only, or lower drives only on either embodiment.

Figure 6:
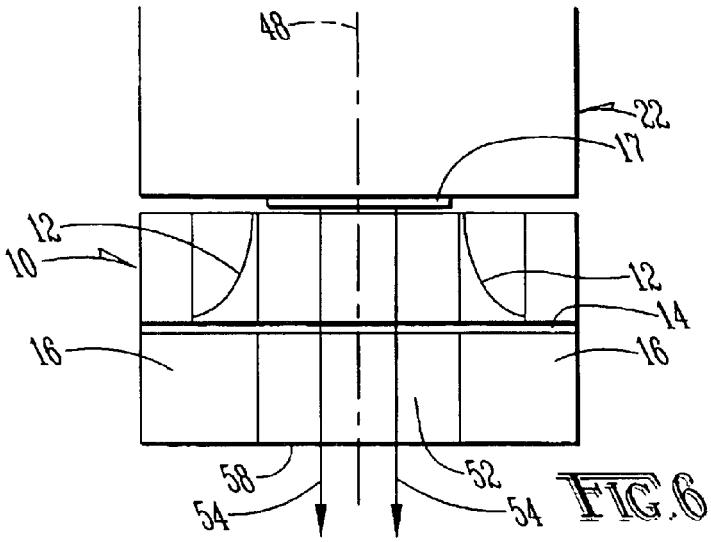
FIGS. 6–11 are overhead, schematic views showing operation of devices of the present invention.
Figure 7:
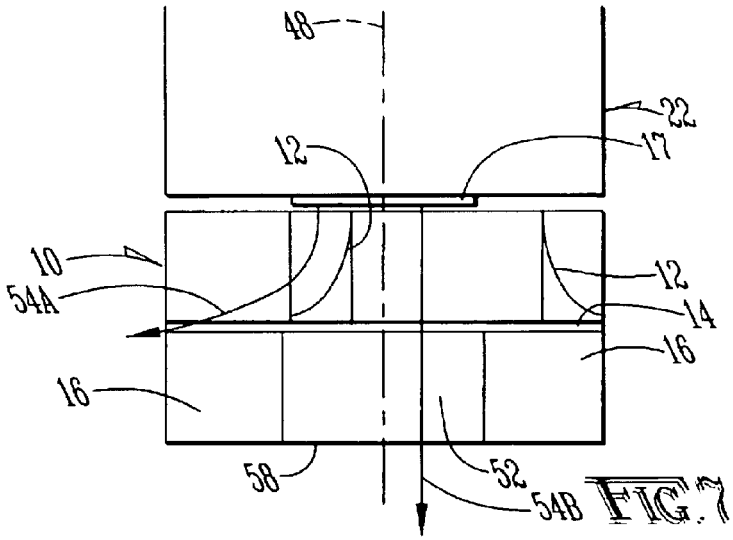
Figure 8:
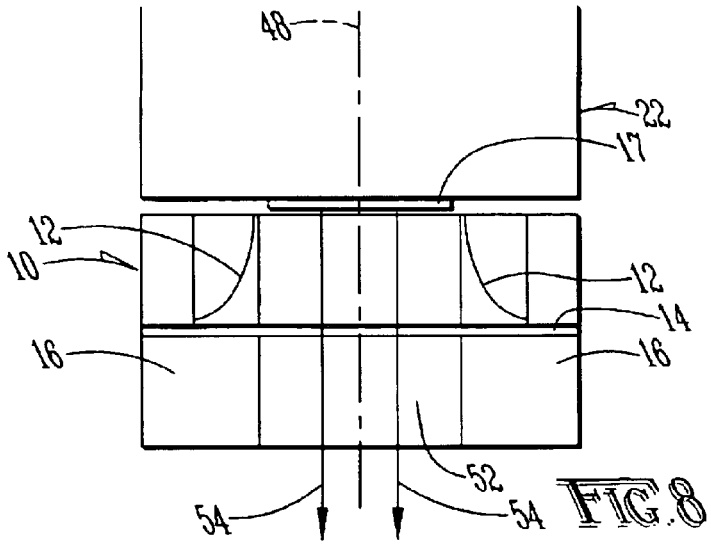
Figure 9:
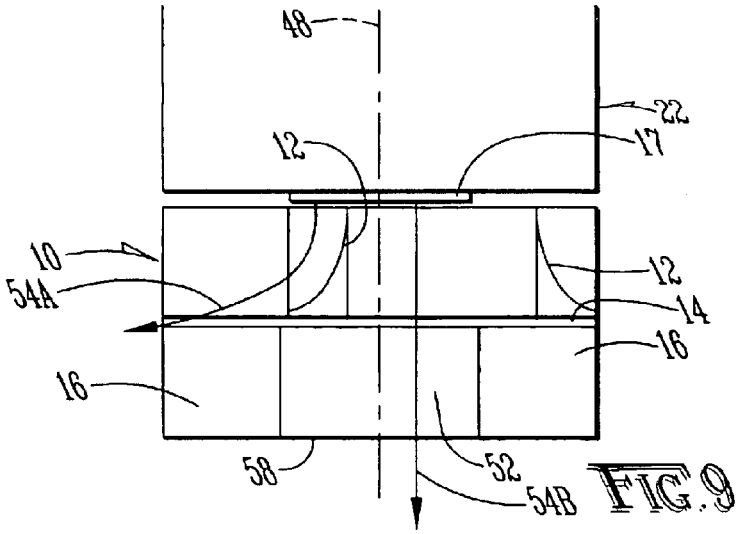

FIGS. 6 and 7 depict the operation of a water craft 22 in accordance with the present invention, using the embodiment in which the port and starboard side diverters 12 are both affixed to a single frame 62. In the full forward operation, a water stream 54 exits the discharge nozzle 34 of the jet propulsion unit 17, passes an inlet opening on the frame 14, through a channel 52 in the frame 14, and past a discharge outlet 58 in the frame 14. The water stream 54 is traveling in a rearward direction that is substantially parallel with a centerline 48 of the water craft 22, so that it provides forward thrust in a direction that is substantially parallel with a centerline 48 of the water craft 22. The port and starboard side diverters 12 are disposed out of the path of the water stream 54, and the port and starboard reverse diverters 16 are disposed out of the path of the water stream 54, behind plates 50. As seen in FIG. 7, to turn the water craft 22 to the left or port side, the frame 62 and side diverters 12 are moved toward the right or starboard side of the water craft 22 so that the plate 66A of the port side diverter 12 enters into the path of the water stream 54. The plate 66A redirects or diverts a portion 54A of the water stream 54 so that it is redirected and discharged through side openings in the diverter frame 62 and in the frame 14 in a direction that is at an angle from the centerline 48 of the water craft 22. The angle is preferably greater than approximately 30° and less than approximately 150° from the centerline 48 of the water craft 22, is more preferably greater than or equal to approximately 50° and less than or equal to approximately 130° from the centerline 48 of the water craft 22, and is most preferably greater than or equal to approximately 70° and less than or equal to approximately 110° from the centerline 48 of the water craft 22. In the most preferred embodiment, the angle is approximately 70° from the centerline 48 of the water craft 22 and provides lateral thrust at an angle of approximately 70° from the centerline 48 of the water craft 22 in the starboard direction. This thrust tends to urge a rear or stern portion of the water craft 22 to the right or starboard direction which in turn tends to urge the front or bow of the water craft 22 to the left or port direction for a left turn. The selected angle is also preferably less than 90° from the centerline 48 of the water craft 20. Using angles approaching or exceeding 90° tends to have a negative impact on top speeds during turning, and sufficient thrust is typically provided at a smaller angle that has a lesser effect on top speeds while turning. The farther the port side diverter 12 is moved into the water stream 54, the larger the portion 54A of the water stream 54 that is diverted or redirected and the greater the lateral thrust provided. While the port side diverter 12 diverts or redirects a portion 54A of the water stream 54, the remaining portion 54B of the water stream 54 continues to travel in a rearward direction that is substantially parallel with a centerline 48 of the water craft 22, so that this portion 54B of the water stream 54 continues to provide forward thrust in a direction that is substantially parallel with a centerline 48 of the water craft 22. The mechanics of turning the water craft 22 to the right or starboard during forward operation is substantially similar and will not be described in detail. Similarly, referring to FIGS. 8 and 9, the mechanics of turning the water craft 22 using independent port and starboard side diverters 12 is very similar. The primary difference being that only the port side diverter 12 would be moved during a forward turn to the left or port side and only the starboard side diverter 12 would be moved during a forward turn to the right or starboard side. When using independently movable port and starboard side diverters 12, an additional feature is available. If an operator wishes to quickly disengage thrust in a forward or reverse direction, both the port and starboard side diverters. 12 could be moved into the path of the water stream 54 so that substantially all of the water stream 54 is diverted to port and starboard sides of the water craft 22 with substantially none of the water stream 54 providing thrust in a forward or reverse direction.

Figure 10:
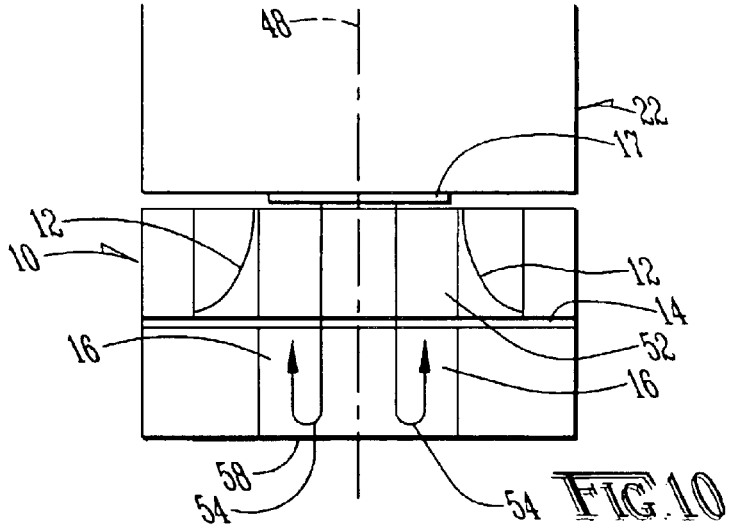
Figure 11:
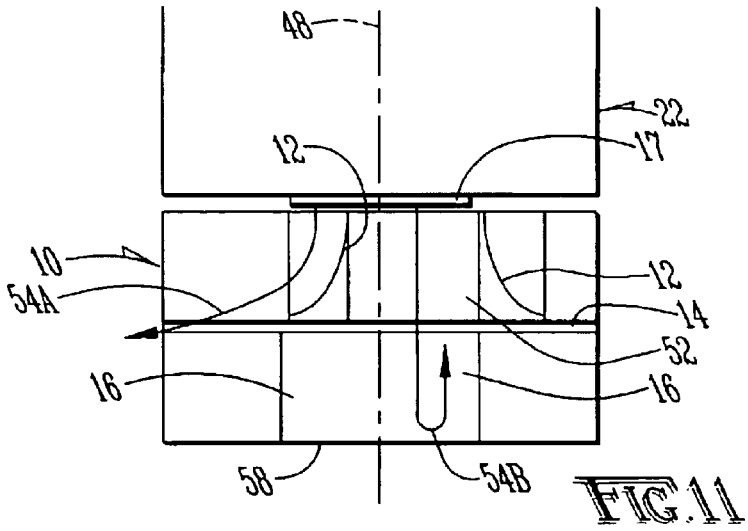

FIGS. 10 and 11 depict reverse operation of the water craft 22. During forward operation, the reverse diverters 16 are disposed to the port and starboard sides of the water stream 54 as it passes through the channel 52. For reverse operation, both reverse diverters 16 are moved in an inboard direction until they meet at or near a centerline of the water stream 54 which may or may not coincide with the centerline 48 of the water craft 22, depending upon the number of jet propulsion units 17 used. As the reverse diverters 16 move in an inboard direction, they progressively divert or redirect larger portions of the water stream 54 to provide greater reverse thrust. In that regard, the portion of the water stream 54 exiting a discharge outlet 76 of a reverse diverter is traveling in a downward, forward direction, thereby providing thrust in an upward, rearward direction that is substantially parallel with the centerline 48 of the water craft 22. Because the side diverters 12 are upstream of the reverse diverters 16, an operator still has full steering capabilities during reverse operation. For example, as depicted in FIG. 11, to turn the rear or stern of the water craft 22 in a starboard direction while the water craft 22 is in reverse, the port side diverter 12 is moved into the path of the water stream 54. The plate 66A redirects or diverts a portion 54A of the water stream 54 so that it is redirected and discharged through side openings in the diverter frame 62 and in the frame 14 in a direction that is preferably at an angle from the centerline 48 of the water craft 22. The angle is preferably greater than approximately 30° and less than approximately 150° from the centerline 48 of the water craft 22, is more preferably greater than or equal to approximately 50° and less than or equal to approximately 130° from the centerline 48 of the water craft 22, and is most preferably greater than or equal to approximately 70° and less than or equal to approximately 110° from the centerline 48 of the water craft 22. In the most preferred embodiment, the angle is approximately 70° from the centerline 48 of the water craft 22 and provides lateral thrust at an angle of approximately 70° from the centerline 48 of the water craft 22 in the starboard direction. This thrust tends to urge a rear or stern portion of the water craft 22 to the right or starboard direction.

The portion 54A of the water stream 54 diverted by the side diverters 12 may provide thrust at any number of different angles, and it is preferred to provide thrust that is at an angle of approximately 70° from the centerline 48 of the water craft 22. The portion 54A of the water stream 54 diverted by a side diverter 12 provides lateral thrust that is preferably not substantially parallel with the centerline 48 of the water craft 22, that is more preferably at an angle that is greater than approximately 30° and less than approximately 150° from the centerline 48 of the water craft 22, that is more preferably at an angle that is greater or equal to approximately 50° and less than or equal to approximately 130° from the centerline 48 of the water craft 22, and that is most preferably at an angle that is greater than or equal to approximately 70° and less than or equal to approximately 110° from the centerline 48 of the water craft 22.

It is also understood that the present invention may be used in connection with water craft 22 having more than one jet propulsion unit 17. A steering device or unit 10 may be associated with each jet propulsion unit 17 and operated in a manner very similar to that described above. The primary modification that may be desirable in such applications would relate to the direction of discharge of water streams 54 from side diverters 12 of adjacent steering units 10. For any side diverter 12 that would discharge a water stream 54 in the general direction of an adjacent steering unit 10, it is preferred that any such side diverter 12 would discharge its water stream 54 in a downward direction in addition to discharging its water stream 54 at an angle from the centerline 48 of the water craft 22. For example, if two jet propulsion units 17 are used, and two steering units 10 are in close proximity to one another, the starboard side diverter 12 of the starboard steering unit 10 would discharge its water stream 54 in a substantially horizontal direction, at an angle of approximately 70° from the centerline 48 of the water craft 22. The port side diverter 12 of the starboard steering unit 10 would discharge its water stream 54 in a downward direction, at an angle of approximately 70° from the centerline 48 of the water craft 22.

Figure 12:
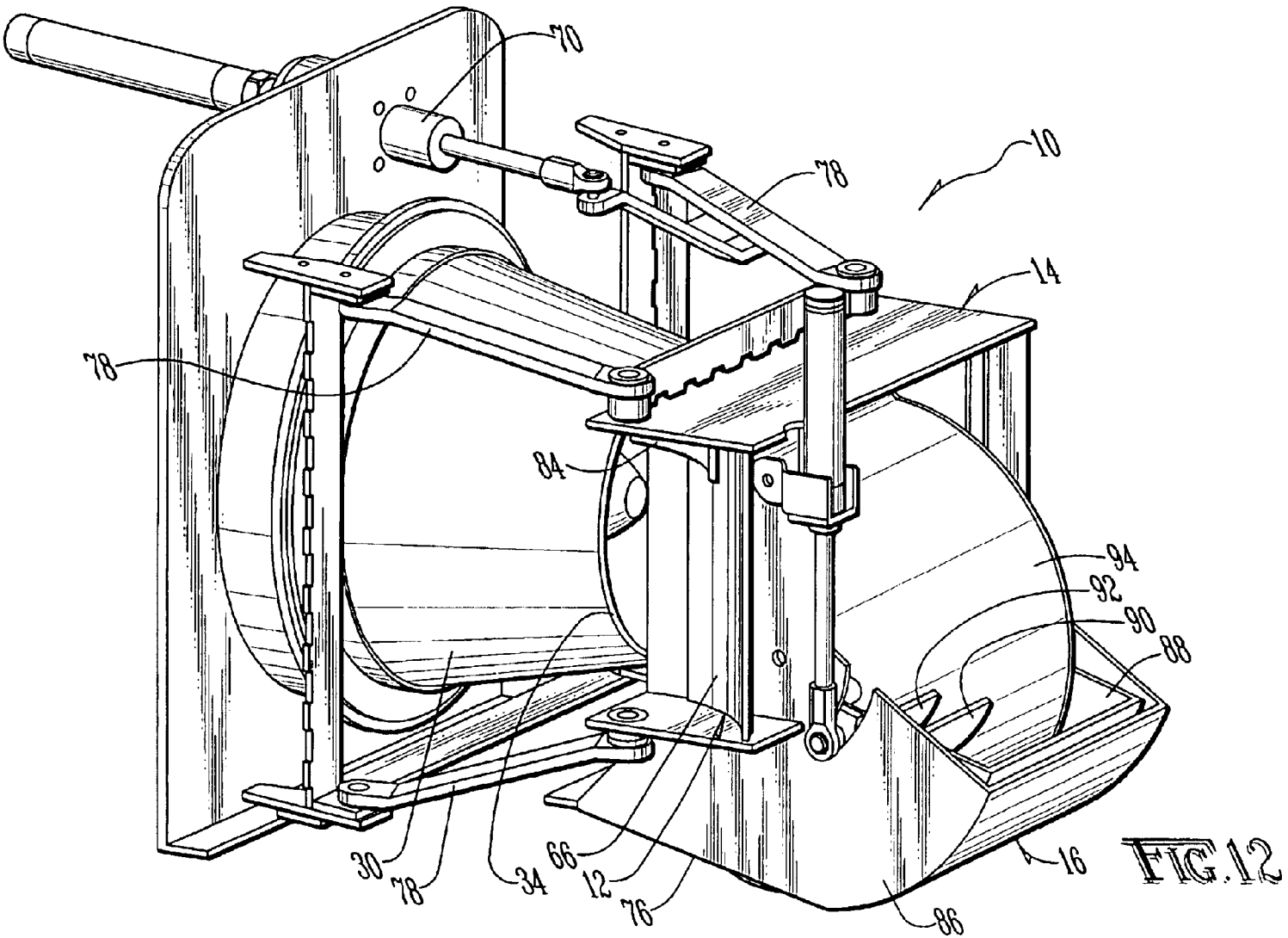
FIG. 12 is a side elevation view of a preferred, alternate embodiment of the present invention.
Figure 13:
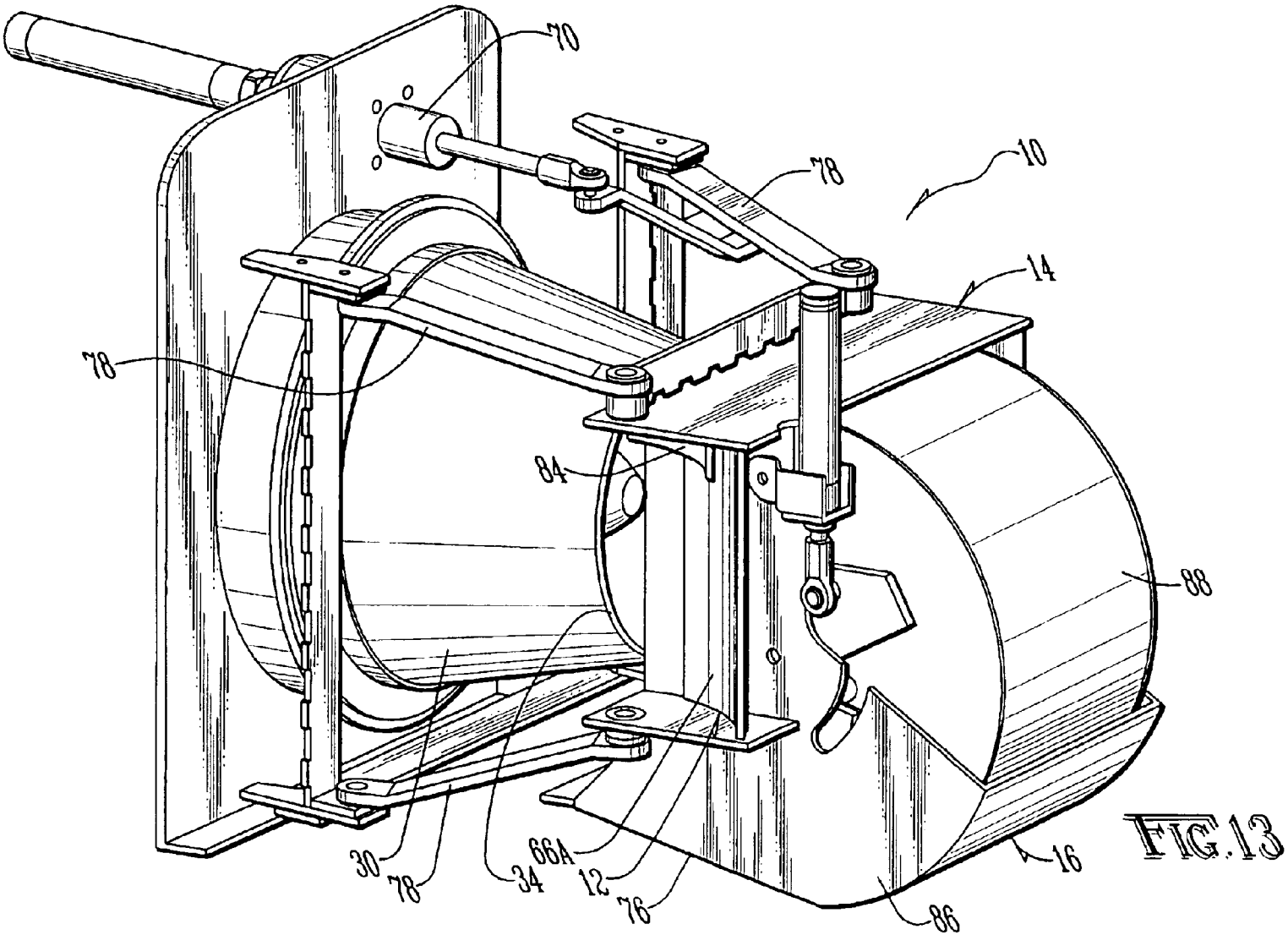
FIG. 13 is a side elevation view of a preferred, alternate embodiment of the present invention, with a reverse diverter deployed.

A preferred embodiment of the present invention is depicted in FIGS. 12–16. In discussing this preferred embodiment, like parts are given like numbers as the related components in the embodiments depicted in FIGS. 1–11. As best seen in FIGS. 12 and 13, elongate members 78 are pivotally secured to the frame 14 at axes 80 and are pivotally secured to the water craft at axes 82. For reasons to be described, the axes 80 are closer together than the axes 82. Similar to the embodiment depicted in FIG. 4, the side diverters 12 are curved plates 66 rigidly affixed to the frame. A shorter curved plate 84 is affixed to the frame 14 aligned substantially parallel with curved plates 66 but extending downward for only a short distance from an upper portion of the frame 14.

The reverse diverter 16 has a lower fixed chute 86 and an upper pivoting chute 88 that is movable between a first position nested with chute portion 86 below and out of the path of the water stream and a second position in which at least a portion of chute portion 88 is disposed in the path of the water stream. FIG. 12 shows chute portion 88 in the first position out of the path of the water stream for forward thrust. In this position, the chute portion 88 also covers and blocks discharge outlet 76 to prevent or reduce drag that might otherwise be created as water from the body of water on which the water craft is being operated attempts to enter the reverse diverter 16 from the wrong direction. The fixed chute 88 has vanes 90, and the pivoting chute 88 has vanes 92 to reduce turbulence losses associated with redirecting a fluid stream. For reasons to be described, the frame 14 has a vertical divider member 94 affixed thereto at a center portion thereof and extending from an upper portion of the frame 14 to a lower portion of the fixed chute 88. FIG. 13 shows chute portion 88 rotated up into a second position into the path of at least a portion of the water stream to provide for reverse thrust.

Figures 14, 15, 16:
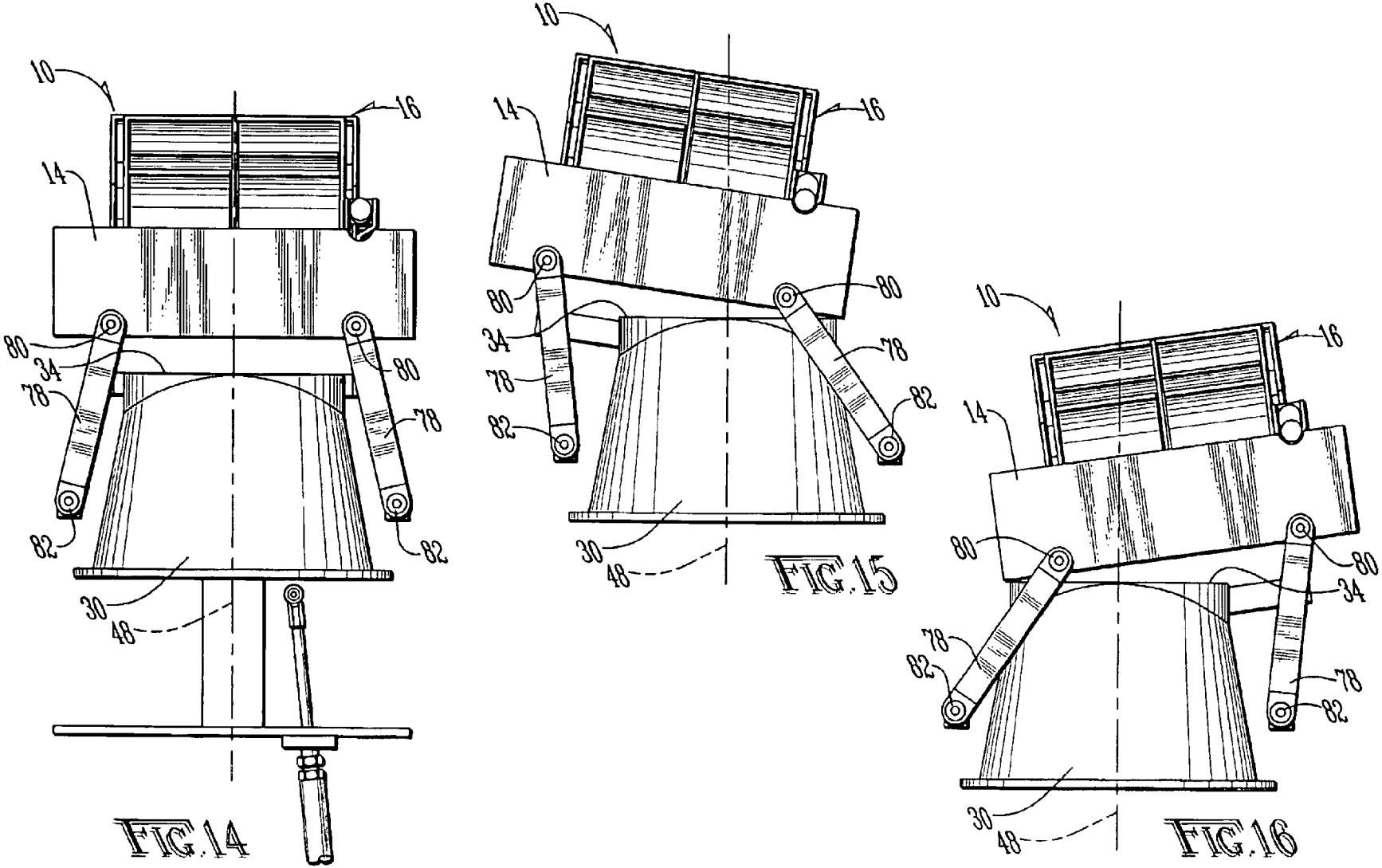
FIGS. 14–16 are overhead, schematic views showing operation of a preferred embodiment of the present invention.

Operation of the preferred embodiment is best seen in FIGS. 14–16. For forward operation of the water craft 22 without turning, the device 10 is positioned as seen in FIG. 14. A front portion of the frame 14 is disposed rearward of and parallel to the discharge exit 34 of the jet propulsion unit. The curved plates 66 of the side diverters 12 are disposed to the sides of and out of the path of the water stream 54 exiting the jet propulsion unit. Similarly, the chute portion 88 of the reverse diverter 16 is in the lowered position, nested within chute portion 86 and out of the path of the water stream 54. The elongate members 78 are disposed so that they are not parallel with one another. In fact, because axes 80 are disposed a shorter distance from one another than axes 82, elongate members will not be disposed parallel to one another as the elongate members 78 move between the various positions. The water stream 54 travels in a rearward direction that is substantially parallel with a centerline 48 of the water craft 22, so that it provides forward thrust in a direction that is substantially parallel with a centerline 48 of the water craft 22.

As seen in FIG. 15, to turn the water craft 22 to the left or port side, the frame 14 is rotated about parallel axes 80 to move at least a portion of the curved plate 66A of the port side diverter 12 into the path of the water stream 54. Because of the positioning of the elongate members 78 and axes 80 and 82, as the plate 66A is rotated into the path of the water stream, the axis 80 disposed near plate 66A will move in an arcuate path toward the discharge exit 34 of the jet propulsion unit. At the same time, the axis 80 disposed near plate 66B of the right or starboard side diverter 12 will move in an arcuate path away from the discharge exit 34 so that plate 66B remains outside of the path of the water stream. In this position, the front portion of frame 14 is no longer disposed parallel to the discharge exit 34 of the jet propulsion unit. In this position, the axis 80 near port plate 66A will not be as far rearward of the discharge exit 34, measured along the centerline 48 of the water craft 22, as it was during straight forward operation as depicted in FIG. 14. Similarly, the axis 80 near starboard plate 66B will be disposed a greater distance rearward of the discharge exit 34, measured along the centerline 48 of the water craft 22, than it was during straight forward operation as depicted in FIG. 14.

The portion of the water stream that is diverted by the plate 66A travels in a direction that is at an angle from the centerline 48 of the water craft 22. The angle is preferably greater than approximately 30° and less than approximately 150° from the centerline 48 of the water craft 22, is more preferably greater than or equal to approximately 50° and less than or equal to approximately 130° from the centerline 48 of the water craft 22, and is most preferably greater than or equal to approximately 70° and less than or equal to approximately 110° from the centerline 48 of the water craft 22. In the most preferred embodiment, the angle is approximately 70° from the centerline 48 of the water craft 22 and provides lateral thrust at an angle of approximately 70° from the centerline 48 of the water craft 22 in the starboard direction. This thrust tends to urge a rear or stern portion of the water craft 22 to the right or starboard direction which in turn tends to urge the front or bow of the water craft 22 to the left or port direction for a left turn. The farther the curved plate 66A of the port side diverter 12 is moved into the water stream 54, the larger the portion of the water stream 54 that is diverted or redirected and the greater the lateral thrust provided.

Left unchecked, water diverted by the curved plates 66 tends to have an undesirable amount of spray directed in an upward direction. This dissipates the available lateral thrust and is generally undesirable for any number of reasons. Plate 84 helps to contain and reduce the spray.

The portion of the water stream 54 that is not diverted by the curved plate 66A will continue in a rearward direction past plate 66A. Some of this water will likely continue rearward undisturbed in a direction that is substantially parallel with a centerline 48 of the water craft 22. Some of this water will likely be diverted slightly by dividing member 94 so that it continues rearward at a small angle of a few degrees from the centerline 48 of the water craft 22. The slightly diverted portion of this water stream 54 will thereby providing a slight amount of lateral thrust in the starboard direction as well, slightly supplementing the lateral thrust provided by water redirected by the curved plate 66A.

To return to forward operation of the water craft 22 without turning, the frame 14 is pivoted in the opposite direction to return to the position shown in FIG. 14. With the frame being off-parallel during turning operations, and with the plate 66A rotating away from the water stream 54, the force needed to withdraw the plate 66A from the water stream is greatly reduced. The mechanics of turning the water craft 22 to the right or starboard during forward operation is substantially similar and will not be described in detail.

For reverse operation of the water craft 22, the pivoting chute portion 88 is rotated upward into the path of the water stream to redirect the water stream in a downward and forward direction through chute portions 88 and 86 and out discharge outlet 76. Vanes 90 and 92 reduce turbulence losses associated with redirecting fluids. Turning during reverse operation is substantially similar to turning during forward operation, with the frame 14 being pivoted about two axes 80 to bring the desired diverter 12 into the path of the water stream 54 for redirecting a portion of the water stream and providing lateral thrust in the desired direction. The dividing member 94 plays a somewhat more important role during reverse operation in that it helps reduce the turbulence losses and dissipation of force that would otherwise occur if water bypassing the side diverter 12 were allowed to quickly disperse to fill the entire cross section area of the chutes 88 and 86. Similar to forward turning, during reverse turning, some of this water that is not diverted by a side diverter 12 will likely continue in a direction that is substantially parallel with a centerline 48 of the water craft 22. Some of this water will also likely be diverted slightly by dividing member 94 so that it is discharged in a forward direction at a small angle of a few degrees from the centerline 48 of the water craft 22. The slightly off-centered portion of this water stream 54 will thereby providing a slight amount of lateral thrust in the relevant direction as well, slightly supplementing the lateral thrust provided by water redirected by the curved plate 66.

Other modifications, changes and substitutions are intended in the foregoing, and in some instances, some features of the invention will be employed without a corresponding use of other features. For example, the side diverters 12 may be used without the reverse diverters 16, and vice versa. Further, it is understood that the diverters may be moved into and out of place in any number of different ways, including but not limited to linear, pivotal or curvilinear movement. The steering device 10 is described for use in connection with water craft 22 but may be used in connection with any number of different things or systems in which it is desirable to selectively divert a portion of a moving stream. It is of course understood that all quantitative information is given by way of example only and is not intended to limit the scope of the present invention.

What is claimed is:

1. A combination, comprising:

a water craft having a jet propulsion discharge outlet;

a frame secured to said water craft, said frame being pivotally secured to said water craft for pivotal movement about two substantially parallel axes; and a first diverter secured to said frame, said first diverter being movable between a first position wherein said first diverter is out of a path of a water stream exiting said jet propulsion discharge outlet and a second position wherein at least a portion of said first diverter is in said path of said water stream, so that in said second position, said first diverter diverts at least a portion of said water stream to provide lateral thrust to said water craft.

2. The combination of claim 1, further comprising:

a second diverter secured to said frame, said second diverter being movable between a first position wherein said second diverter is out of said path of said water stream and a second position wherein at least a portion of said second diverter is in said path of said water stream, so that in said second position, said second diverter diverts at least a portion of said water stream to provide lateral thrust to said water craft.

3. The combination of claim 1, further comprising:

a first elongate member pivotally secured to said water craft at a first location and pivotally secured to said frame at a second location;

a second elongate member pivotally secured to said water craft at a third location and pivotally secured to said frame at a fourth location, said first, second, third, and fourth locations being disposed so that a first distance between said first location and said third location is less than a second distance between said second location and said fourth location.

4. The combination of claim 3, wherein said first and second elongate members are disposed so that when said first diverter is in said first position, said first and second elongate members are not substantially parallel with a center line of said water craft.

5. The combination of claim 3, wherein said first elongate member is disposed so that it is not parallel to said second elongate member as said first diverter moves between said first and second positions.

6. The combination of claim 1, further comprising:

a reverse diverter secured to said frame, said reverse diverter being movable between a first position in which said first reverse diverter is out of said path of said water stream and a second position in which at least a portion of said reverse diverter is in said path of said water stream, so that in said second position, said reverse diverter diverts at least a portion of said water stream to provide reverse thrust to said water craft.

7. The combination of claim 1, wherein said first diverter comprises a curved plate rigidly affixed to said frame.

8. The combination of claim 1, wherein said first diverter is disposed so that, when said first diverter is in said second position, said first diverter diverts said at least said portion of said water stream to provide said lateral thrust to said water craft at an angle from a centerline of said water craft that is greater than approximately 30° and less than approximately 150°.

9. The combination of claim 8, wherein said angle is greater than or equal to approximately 50° and less than or equal to approximately 130°.

10. The combination of claim 8, wherein said angle is greater than or equal to approximately 70° and less than or equal to approximately 110°.

11. A method, comprising:

(1) providing a water craft having a jet propulsion unit for generating a water stream to provide forward thrust to said water craft;

(2) providing a frame having a first diverter, said first diverter being movable between a first position wherein said first diverter is out of a path of said water stream and a second position wherein at least a portion of said first diverter is in said path of said water stream, so that in said second position, said first diverter diverts at least a portion of said water stream to provide lateral thrust to said water craft; and (3) rotating said frame about first and second axes to move said first diverter between said first position and said second position.

12. The method of claim 11, wherein step (3) comprises:

rotating said frame about first and second axes to move said first diverter between said first position and said second position, said first and second axes being substantially parallel.

13. The method of claim 11, further comprising:

moving said first and second axes in arcuate paths relative to said water craft as said frame rotates about said first and second axes.

14. The method of claim 11, further comprising:

providing a second diverter affixed to said frame, said second diverter being movable between said first position wherein said first diverter and said second diverter are out of said path of said water stream, said second position wherein at least a portion of said first diverter is in said path of said water stream and said second diverter is out of said path of said water stream, and a third position wherein at least a portion of said second diverter is in said path of said water stream and said first diverter is out of said path of said water stream, so that in said third position, said second diverter diverts at least a portion of said water stream to provide lateral thrust to said water craft; and rotating said frame about said first and second axes to move said first and second diverters between said first, second, and third positions.

15. The method of claim 14, wherein:

said jet propulsion unit has a discharge exit and said water craft has a centerline;

when said first and second diverters are in said first position, said first axis is disposed a first distance rearward of said discharge exit, measured along said centerline, when said first and second diverters are in said second position, said first axis is disposed a second distance rearward of said discharge exit, measured along said centerline, and when said first and second diverters are in said third position, said first axis is disposed a third distance rearward of said discharge exit, measured along said centerline, said first distance being greater than said second distance and less than said third distance.

16. The method of claim 15, wherein:

when said first and second diverters are in said first position, said second axis is disposed a fourth distance rearward of said discharge exit, measured along said centerline, when said first and second diverters are in said second position, said second axis is disposed a fifth distance rearward of said discharge exit, measured along said centerline, and when said first and second diverters are in said third position, said second axis is disposed a sixth distance rearward of said discharge exit, measured along said centerline, said fourth distance being greater than said sixth distance and less than said fifth distance.

17. A combination, comprising:

a frame;

a first elongate member having proximal and distal end portions, said proximal end portion of said first elongate member being pivotal about a first axis and said distal end portion of said first elongate member being pivotally secured to said frame for pivoting about a second axis;

a second elongate member having proximal and distal end portions, said proximal end portion of said second elongate member being pivotal about a third axis and said distal end portion of said second elongate member being pivotally secured to said frame for pivoting about a fourth axis, said first axis being a first distance from said third axis and said second axis being a second distance from said fourth axis, said first distance being greater than said second distance;

a first curved wall affixed to a right side portion of said frame; and a second curved wall affixed to a left side portion of said frame.

18. The combination of claim 17, further comprising:

a third elongate member having proximal and distal end portions, said proximal end portion of said third elongate member being pivotal about said first axis and said distal end portion of said third elongate member being pivotally secured to said frame for pivoting about said second axis; and a fourth elongate member having proximal and distal end portions, said proximal end portion of said fourth elongate member being pivotal about said third axis and said distal end portion of said fourth elongate member being pivotally secured to said frame for pivoting about said fourth axis.

19. The combination of claim 17, further comprising:

a water craft, said proximal end portion of said first elongate member being pivotally secured to said water craft for pivoting about said first axis, and said proximal end portion of said second elongate member being pivotally secured to said water craft for pivoting about said third axis; and a third curved wall pivotally secured to said frame for pivoting about a fifth axis, said fifth axis being substantially perpendicular to said second axis.

20. The combination of claim 19, wherein said first elongate member is disposed so that it may not be aligned parallel with said second elongate member.

* * * * *